US006315627B1

(12) United States Patent
Thai

(10) Patent No.: US 6,315,627 B1
(45) Date of Patent: Nov. 13, 2001

(54) BUBBLE GENERATING ASSEMBLY

(75) Inventor: Douglas Thai, Walnut, CA (US)

(73) Assignee: Placo Corporation Ltd. (HK)

( * ) Notice: Subject to any disclaimer, the term of this patent is extended or adjusted under 35 U.S.C. 154(b) by 0 days.

(21) Appl. No.: 09/551,814

(22) Filed: Apr. 18, 2000

Related U.S. Application Data

(63) Continuation-in-part of application No. 09/347,973, filed on Jul. 6, 1999, now Pat. No. 6,149,486, which is a continuation-in-part of application No. 09/277,512, filed on Mar. 26, 1999, now Pat. No. 6,102,764, which is a continuation-in-part of application No. 09/207,542, filed on Dec. 8, 1998, now Pat. No. 6,139,391.

(51) Int. Cl.[7] ..... A63H 33/28
(52) U.S. Cl. ..... 446/15
(58) Field of Search ..... 446/15, 16, 17, 446/18, 19, 20, 21

(56) References Cited

U.S. PATENT DOCUMENTS

| | | | | |
|---|---|---|---|---|
| D. 263,062 | | 2/1982 | Rasmussen . | |
| D. 304,466 | | 11/1989 | Brown . | |
| 2,041,423 | | 5/1936 | Mausolf . | |
| 2,213,391 | | 9/1940 | Gamble . | |
| 2,547,825 | | 4/1951 | King . | |
| 2,632,281 | | 3/1953 | Schmidt, Jr. . | |
| 2,736,988 | * | 3/1956 | Fisher | 446/17 |
| 2,987,847 | * | 6/1961 | Jones . | |
| 3,071,888 | * | 1/1963 | Knott . | |
| 3,323,250 | | 6/1967 | Gibbons . | |
| 3,731,412 | * | 5/1973 | Winslow | 40/106.21 |
| 4,246,717 | | 1/1981 | Wachtel . | |
| 4,467,552 | | 8/1984 | Jernigan . | |
| 4,481,731 | | 11/1984 | La Fata et al. . | |
| 4,775,348 | * | 10/1988 | Collins | 446/16 |
| 5,035,665 | | 7/1991 | Sheng . | |
| 5,498,191 | | 3/1996 | DeMars . | |
| 5,653,620 | | 8/1997 | Lin . | |
| 5,695,379 | | 12/1997 | Ho . | |
| 5,842,899 | | 12/1998 | Cernansky et al. . | |

FOREIGN PATENT DOCUMENTS

| | | | | |
|---|---|---|---|---|
| 1329796 | | 9/1973 | (GB) . | |
| 2224951 | | 5/1990 | (GB) . | |
| 2162077-a | * | 1/1986 | (GB) | 446/20 |
| 13268 | * | 1/1924 | (NL) | 446/15 |

* cited by examiner

*Primary Examiner*—D. Neal Muir
(74) *Attorney, Agent, or Firm*—Raymond Sun

(57) ABSTRACT

A bubble producing assembly has a plurality of bubble producing devices. Each bubble producing device has at least one loop, a fan positioned adjacent the at least one loop, and a motor coupled to the fan. The assembly has a control mechanism coupled to each motor of each bubble producing device for simultaneously actuating each motor to cause separate bubbles to be simultaneously produced.

19 Claims, 18 Drawing Sheets

BUBBLE GENERATING ASSEMBLY

RELATED CASES

This is a continuation-in-part of Ser. No. 09/347,973, entitled "Bubble Generating Assembly", filed Jul. 6, 1999, now U.S. Pat. No. 6,149,486 which is in turn a continuation-in-part of Ser. No. 09/277,512, entitled "Bubble Gene filed Mar. 26, 1999, now U.S. Pat. No. 6,102,764 which is in turn a continuation-in-part of Ser. No. 09/207,542, entitled "Bubble Generating Assembly", filed Dec. 8, 1998, now U.S. Pat. No. 6,139,391 whose disclosures are incorporated by this reference as though fully set forth herein.

BACKGROUND OF THE INVENTION

1. Field of the Invention

The present invention relates to bubble-producing devices, and in particular, to a simple toy that is capable of producing bubbles within a larger enclosing bubble, and of simultaneously producing a plurality of separate bubbles.

2. Description of the Prior Art

Bubble producing toys are very popular among children who enjoy producing bubbles of different shapes and sizes. Many bubble producing toys have previously been provided. Perhaps the simplest example has a stick with a circular opening or port at one end, resembling a wand. A film is produced when the port is dipped into a bubble solution or bubble producing fluid (such as soap) and then removed therefrom. Bubbles are then formed by blowing carefully against the film. Such a toy requires dipping every time a bubble is to created, and the bubble solution must accompany the wand from one location to another. Another drawback is that only one bubble can be produced at a time. Therefore, such simple bubble producing toys offer limited amusement and are limited in the types, shapes and sizes of the bubbles that they can produce.

As a result, attempts have been made to provide bubble producing toys that offer more variety and amusement. For example, U.S. Pat. No. 2,041,423 (Mausolf) discloses a soap bubble pipe that produces a cluster of three soap bubbles. U.S. Pat. No. 2,213,391 (Gamble) discloses a bubble blower that produces three bubbles, one bubble within the other. U.S. Pat. No. 4,467,552 (Jernigan) discloses a bubble within a larger exterior bubble.

Unfortunately, each of these devices has limited applications. For example, the device in U.S. Pat. No. 2,041,423 (Mausolf) can only produce a cluster of three bubbles. Also, the devices disclosed in U.S. Pat. No. 2,213,391 (Gamble) and U.S. Pat. No. 4,467,552 (Jernigan) can only produce one bubble within an outer bubble.

Another drawback associated with previously known or available bubble producing devices is that they do not always consistently produce complete bubbles. This problem is typically experienced by devices that attempt to produce more than one bubble, since the bubble solution may not adequately cover or coat all the surfaces of the loops and shapes that define these multiple bubbles.

Thus, there remains a need to provide devices that can produce different configurations and variations of bubbles so as to enhance the amusement value and play variety for children.

SUMMARY OF THE DISCLOSURE

It is an object of the present invention to provide a bubble producing device that produces a plurality of bubbles within an outer enclosing bubble.

It is another object of the present invention to provide a bubble producing device that produces a plurality of bubbles within an outer enclosing bubble that is in itself one of a plurality of bubbles that are enclosed within another larger outer enclosing bubble.

It is yet another object of the present invention to provide a bubble producing device that consistently produces complete bubbles.

It is a further object of the present invention to provide a bubble producing device that produces a plurality of separate bubbles upon the actuation of a single control mechanism.

The objectives of the present invention are accomplished by providing a bubble producing device that has a primary loop having an enclosing edge that defines an interior opening, with the primary loop disposed at a first vertical level. The bubble producing device also includes a plurality of secondary loops disposed at a second vertical level that is different from the first vertical level, the secondary loops positioned with respect to the primary loop such that the secondary loops extend into the space defined by the interior opening. In a preferred embodiment, the secondary loops are smaller in size than the primary loop.

In yet another embodiment, the secondary loop has a cylindrical wall extending vertically therefrom. The wall can have an angled configuration, with a circumference having a varying length.

In yet a further embodiment, a bubble producing assembly is provided having a plurality of bubble producing devices. Each bubble producing device has at least one loop, a fan positioned adjacent the loop, and a motor coupled to the fan. The assembly has a control mechanism coupled to each motor of each bubble producing device for simultaneously actuating each motor to cause separate bubbles to be simultaneously produced.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides a bubble producing device that produces multiple bubbles within an exterior enclosing bubble. The exterior enclosing bubble may itself be one of a multiple of other bubbles (each having one or more bubbles enclosed therewithin) that are in turn enclosed within a larger exterior enclosing bubble. The present invention accomplishes this by providing bubble producing openings or loops at different levels, or in other words, by layering these loops in a manner such that the plurality of loops at one level are vertically offset from the loops at other levels.

The present invention also provides a bubble producing device that produces a plurality of separate bubbles upon the actuation of a single control mechanism. This will be illustrated in connection with FIGS. 15–18.

Figure 1:
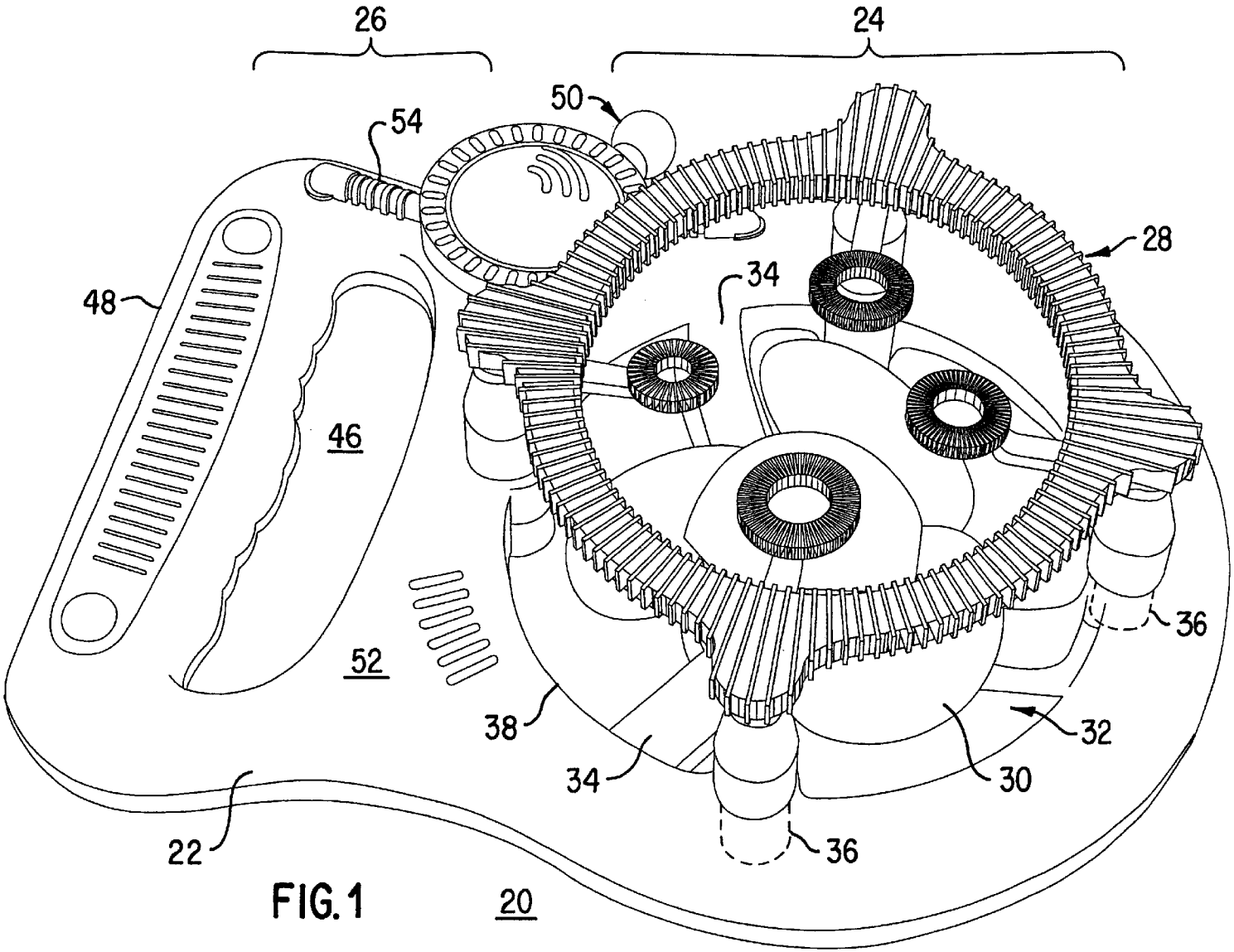
FIG. 1 is a top perspective view of a bubble producing assembly according to one embodiment of the present invention.

FIG. 1 illustrates a bubble producing assembly 20 according to one embodiment of the present invention. The assembly has a frame 22 that includes a support section 24 and a handle section 26. The support section 24 is adapted to receive a bubble producing device 28, as described below, and includes a fan 30 that is positioned below the bubble producing device 28 for generating air to produce bubbles. Specifically, the support section 24 has a central opening 32 extending through the frame 22 and into which a plurality of radial ribs 34 extend. The ribs 34 meet at a central point in the central opening 32 at which the fan 30 is supported. A plurality of openings 36 (shown in phantom) are provided along the edge 38 of the central opening 32 for receiving protrusions of the bubble producing device 28, as explained below.

The handle section 26 has an elongated opening 46 adjacent an end 48 of the frame 22 for allowing a user's fingers to be inserted therethrough. The edges of the elongated opening 46 can be serrated or curved to receive the respective fingers of a user's hand. Thus, a user can insert his or her fingers through the elongated opening 46 to grip the frame 22 and the assembly 20. In addition, a lever mechanism 50 is provided at the top surface 52 of the frame 22 adjacent a side edge 54 of the frame 22 to allow the user to control the speed of rotation of the fan 30. The lever mechanism 50 is illustrated as being provided adjacent one side edge 54 of the frame 22 and between the handle section 26 and the support section 24 in the present embodiment, although it can be positioned anywhere in the assembly 20 as long as it can be conveniently coupled to the fan 30 to drive the fan 30.

Figure 10B:
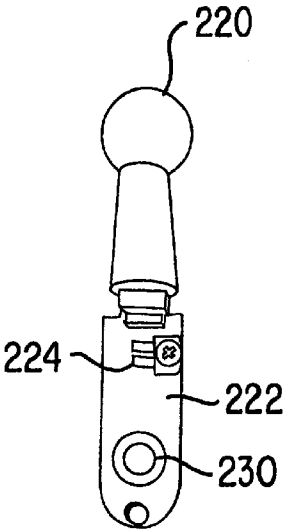
FIGS. 10A and 10B illustrate how the lever of FIG. 1. operates to control the fan.
Figure 9:
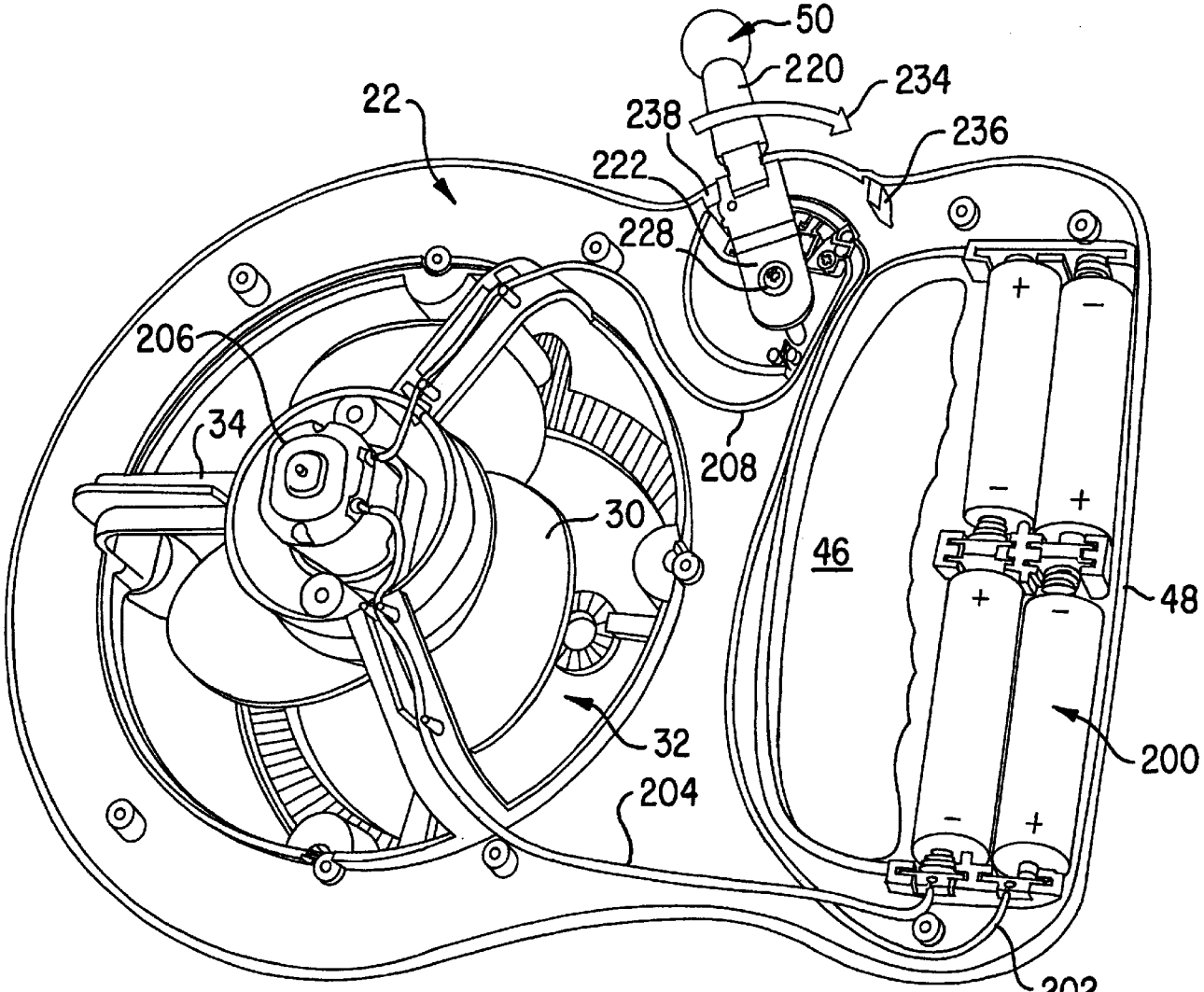
FIG. 9 is a bottom perspective view of the assembly of FIG.
Figure 11:
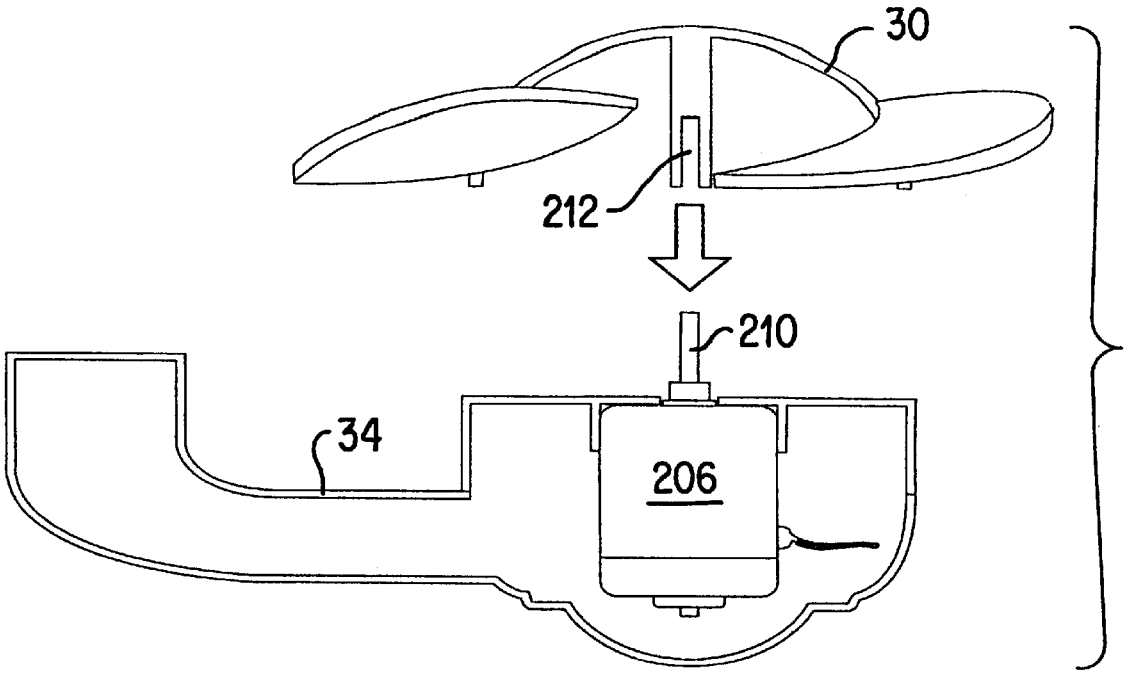
FIG. 11 illustrates how the fan of FIG. 1 is coupled to the motor.

FIGS. 9–11 illustrate how the lever mechanism 50 controls the rotation of the fan 30. FIG. 9 is a bottom perspective view of the assembly 20 with the bottom surface of the frame 22 removed. First, the handle section 26 houses a battery system 200 having a plurality of batteries. A first wire 202 couples the contacts of the battery system 200 to the lever mechanism 50, while a second wire 204 couples the contacts of the battery system 200 to a motor 206 to power the motor 206. A third wire 208 couples the lever mechanism 50 to the motor 206 to drive the motor 206. The second and third wires 204 and 208 are supported underneath the frame 22 and the ribs 34. Referring to FIG. 11, the motor 206 has a rotatable shaft 210 that is received inside a bore 212 in the fan 30 to rotate the fan 30.

Figure 10A:
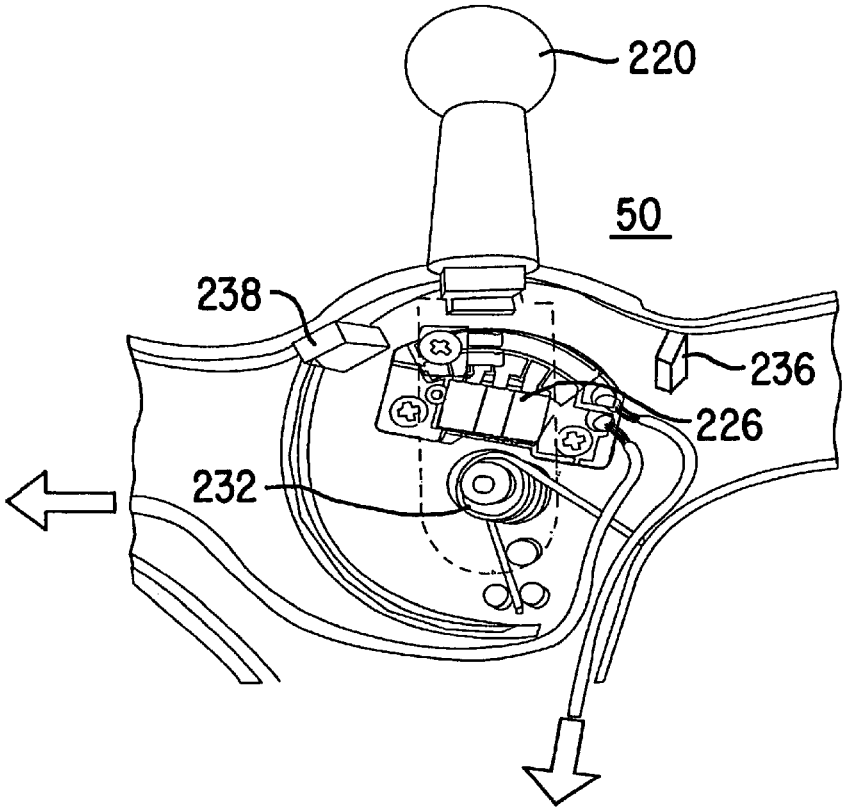

The lever mechanism 50 is illustrated in greater detail in FIGS. 10A and 10B. FIG. 10A is an expanded view of the lever mechanism 50 as taken from FIG. 9, with a portion of the lever plate 222 shown in phantom. FIG. 10B is a view of the underside (i.e., opposite to that shown in FIG. 10A) of the lever mechanism 50 as seen from the top surface 52 of the frame 22. The lever mechanism has a lever arm 220 coupled to a plate 222 (see FIGS. 9 and 10B, and shown in phantom in FIG. 10A) that extends through an opening (not shown) in the side edge 54 of the frame 22. An electrical conductor (i.e., contacts) 224 is provided on the underside of the plate 222 and adapted to contact or couple to one of a plurality of conductors 226 provided on the underside of the top surface 52 of the frame 22. Each of the plurality of conductors 226 is adapted to control rotation of the fan 30 at a different speed, as explained below. A screw 228 extends through a screw hole 230 in the plate 222 to secure the plate 222 in a pivotable connection with the frame 22. The lever mechanism 50 also includes a spring 232 that is supported by the screw 228 between the plate 222 and the frame 22. The spring 232 operates to normally bias the plate 222 back to the "OFF" position shown in FIG. 9. Two stop edges 236, 238 define the limits to which the lever plate 222 can be pivoted.

In operation, the lever mechanism 50 is shown in FIG. 9 in the "OFF" position adjacent the stop edge 238, where the fan 30 is not rotated. If it is desired to rotate the fan 30, the user pivots the lever arm 220 in the direction of arrow 234 to cause the lever conductor 224 to contact a first of the conductors 226, thereby causing the fan 30 to rotate at a first speed. Turning the lever arm 220 further in the direction of arrow 234 will cause the lever conductor 224 to contact a second of the conductors 226, thereby causing the fan 30 to rotate at a second faster speed, and so on. When the user releases the lever arm 220, the spring 232 will bias the plate 222 and lever 220 back to the "OFF" position.

Although the present invention is illustrated as utilizing a motor that is integral with the assembly 20 to drive the fan 30, it is also possible to utilize the assembly 20 with other air generation devices (e,g., blowing by mouth, or a separate fan) without the use of an integral motorized fan.

Figure 2:
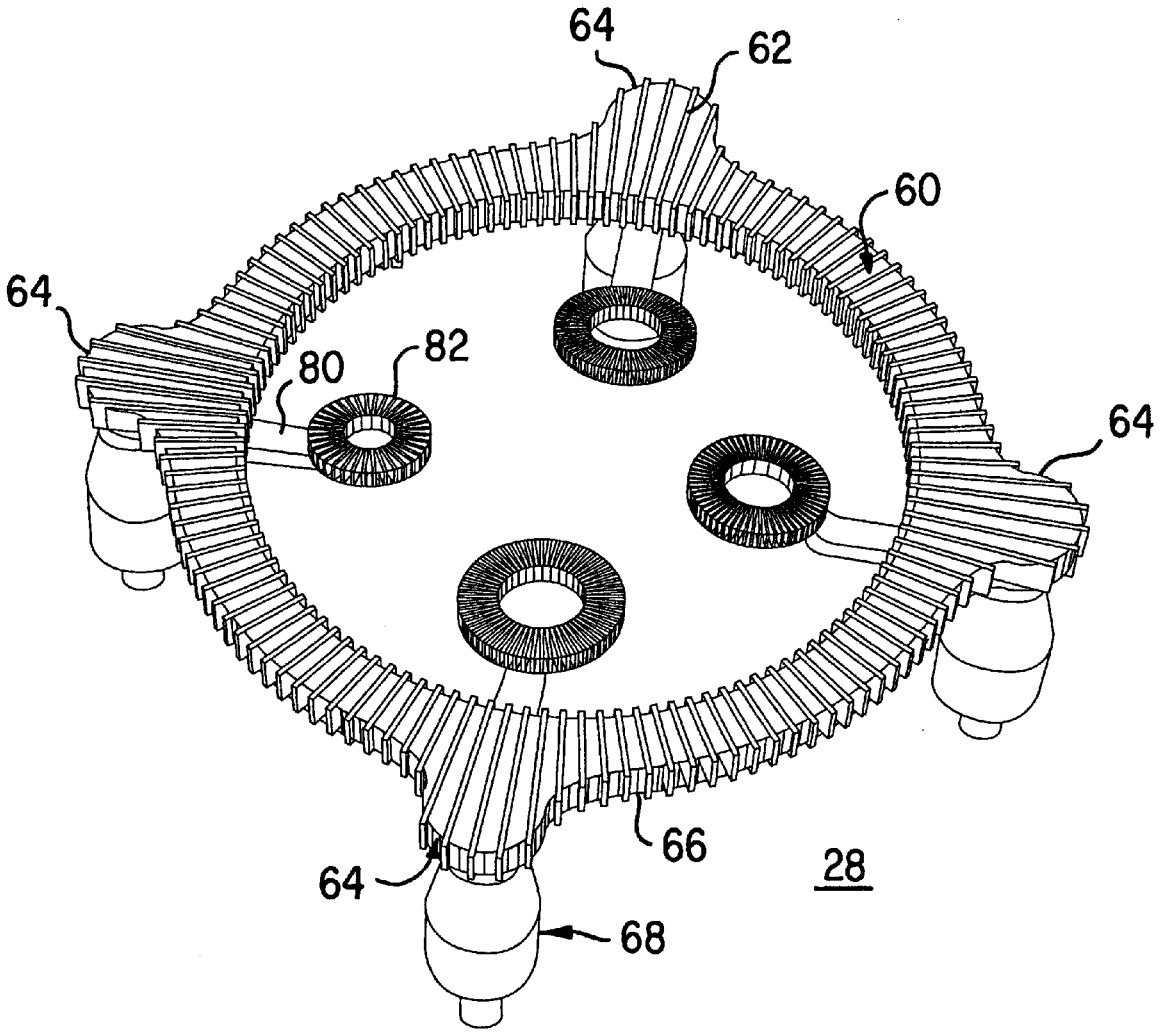
FIG. 2 is a perspective view of the bubble producing device of the assembly of FIG. 1.
Figure 3:
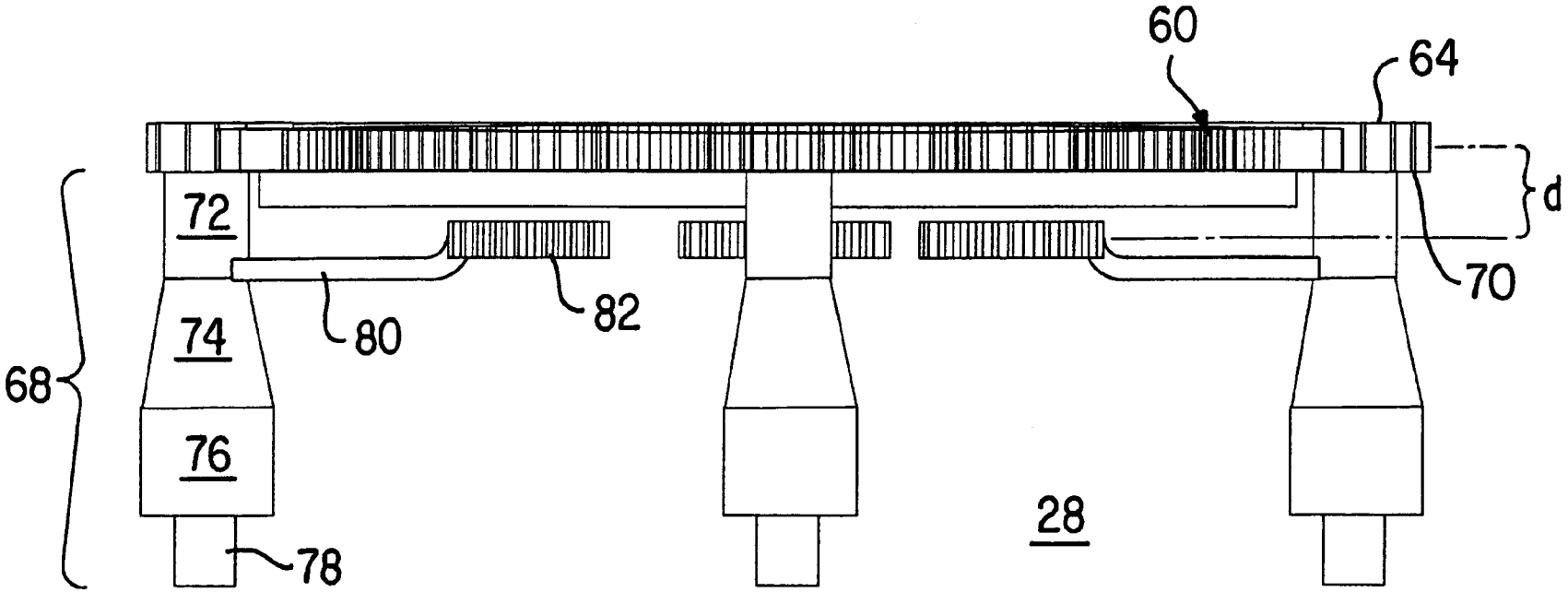
FIG. 3 is a side plan view of the bubble producing device of FIG. 2.
Figure 4:
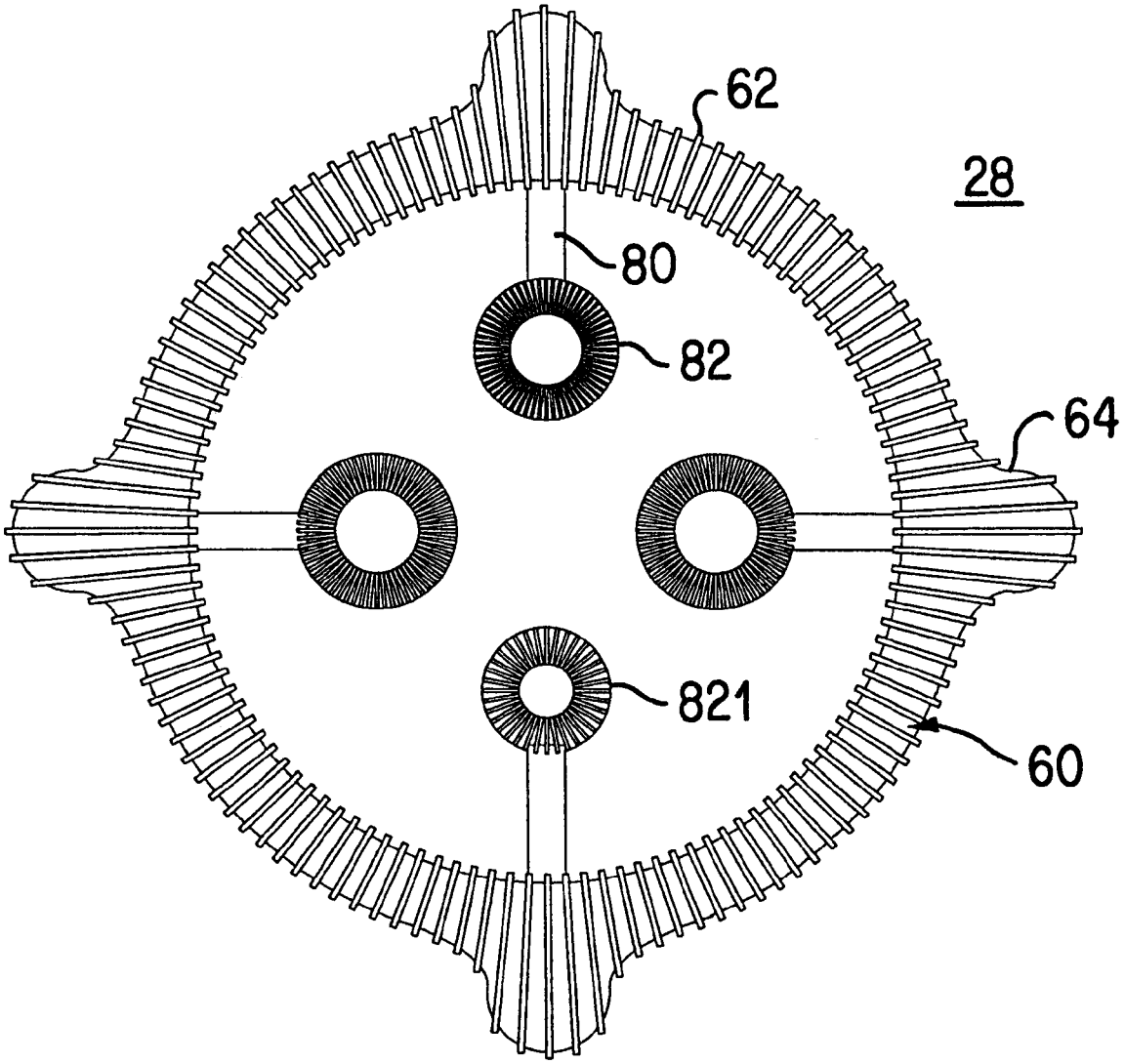
FIG. 4 is a top elevation view of the bubble producing device of FIG. 2.

The bubble producing device 28 is illustrated in greater detail in FIGS. 2–4. The bubble producing device 28 is essentially a ring-like loop having a primary serratted ring 60, such that ridges or bumps 62 are provided on the outer surfaces of the primary ring 60. The ridges 62 function to hold the bubble solution against the ring 60 to form a solution film that is blown to form the bubble. The ring 60 can have any desired shape. A plurality of extensions or flanges 64 extend from the outer periphery 66 of the primary ring 60. These flanges 64 can be spaced-apart in an equidistant manner from each other, or provided at any desired spacing. In addition, any number (i.e., two or more) of the flanges 64 and their corresponding legs and secondary rings can be chosen by the designer. A leg 68 extends vertically from the bottom surface 70 of each flange 64. Each leg 68 has a thin upper portion 72 extending from the bottom surface 70 to a tapered portion 74 that resembles a truncated cone. The narrower end of the tapered portion 74 connects the bottom end of the upper portion 72, and the wider end of the tapered portion 74 connects the top end of a wide base portion 76. A vertical protrusion 78 extends vertically from the bottom end of the base portion 76, and is adapted to be inserted into a corresponding one of the openings 36 that are provided along the edge 38 of the central opening 32. In addition, a tongue 80 has a first end connected to the leg 68 adjacent the connection between the upper portion 72 and the tapered portion 74, and a second end that extends radially into the interior of the primary ring 60 and connects and supports a secondary ring 82. The secondary ring 82 can have any desired shape, such as the shape of the primary ring 60 or any other shape, but it is preferably smaller than the primary ring 60. The secondary rings 82 can also have ridges 62, like the primary ring 60. Also, as best illustrated in FIGS. 2 and 3, the secondary ring 82 is vertically offset from the primary ring 60 by a distance d (measured from the middle of the rings 60 and 82) by virtue of the connection of the tongue 80 to the leg 68 at a vertical level below the leg's 68 connection to the flange 64 of the primary ring 60. In addition, the tongue 80 and its secondary ring 82 can be disposed generally parallel to the planar orientation of the primary ring 60. All the legs 68, tongues 80 and secondary rings 82 of the flanges 64 can be of the same construction, although the shapes and sizes of the secondary rings 82 can be different. For example, in FIG. 4, one secondary ring 821 is smaller than the other secondary rings 82, and operates to produce smaller bubbles.

Each of the primary ring 60 and secondary rings 82 are provided to create a separate bubble. The secondary rings 82 are provided at a vertical level offset from the primary ring 60 so as to allow a plurality of smaller bubbles to be produced. The inventor has found that if the secondary rings 82 are positioned at the same vertical level as the primary ring 60, the result may be that only one large bubble (i.e., emanating from the primary ring 60) is produced or a plurality of irregular bubbles (i.e., emanating from the internal spaces between the primary ring 60 and the secondary rings 82) are produced without an enclosing larger bubble. In addition, the secondary rings 82 are smaller in size than the primary ring 60 to ensure that the resultant bubbles are smaller and sized to fit inside the larger enclosing bubble produced by the primary ring 60.

Figure 5:
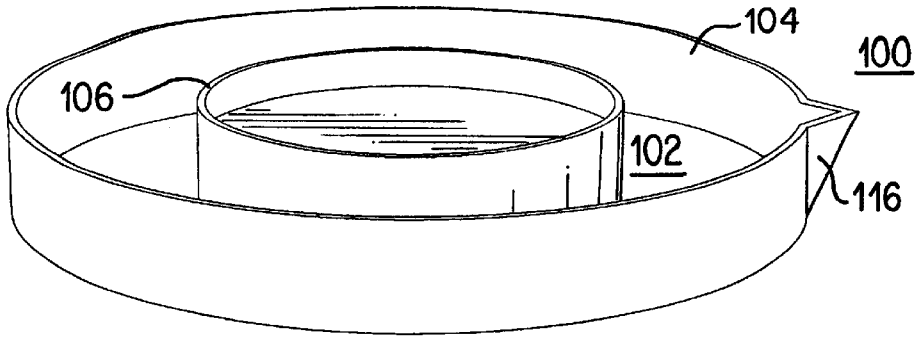
FIG. 5 is a perspective view of a bubble solution dish that can be used with the bubble producing device of FIG. 2.
Figure 6:
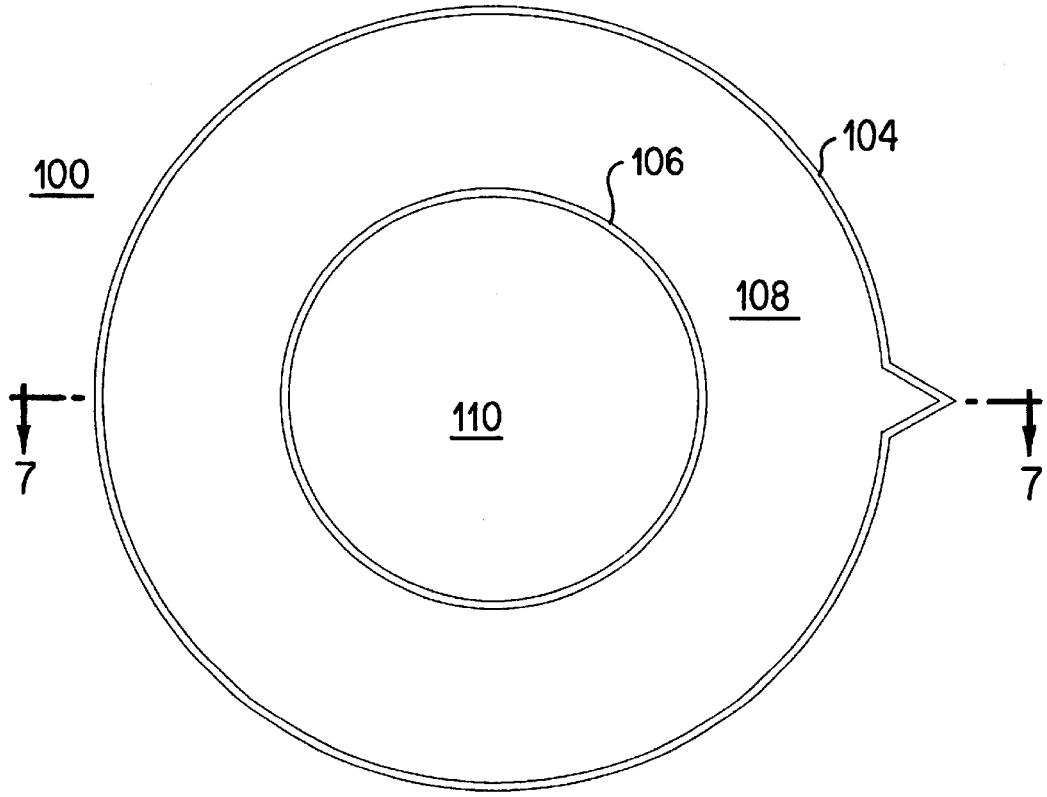
FIG. 6 is a top elevation view of the dish of FIG. 5.
Figure 7:
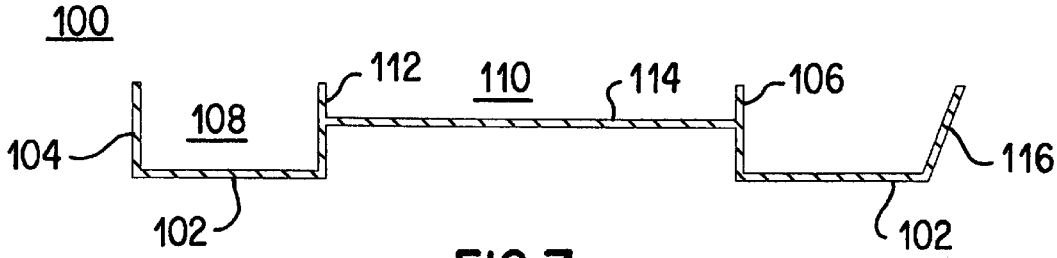
FIG. 7 is a cross-sectional view of the dish of FIG. 6 taken along line 7—7 thereof.

FIGS. 5–7 illustrate a bubble solution dish 100 that can be used with the bubble producing device 28 of FIGS. 2–4. The dish 100 has a base plate 102 and a shallow outer enclosing wall 104 extending around the base plate 102. An inner enclosing wall 106 defines an annular outer space or compartment 108 between the inner wall 106 and the outer wall 104. In addition, a generally circular inner space or compartment 110 is defined by the inner surface 112 of the inner wall 106. The inner space 110 has an inner plate 114 that is at a higher vertical level than the base plate 102. The shapes and sizes of the inner and outer walls 106 and 104, respectively, are dependent on the shape, size and positions of the primary ring 60 and the secondary rings 82. These spaces 108, 110 are vertically offset from each other because the outer space 108 is adapted to receive the primary ring 60 and the inner space 110 is adapted is adapted to receive the secondary rings 82. In addition, the dish 100 has a generally circular configuration because the primary ring 60 is generally circular. Moreover, a sharp spout 116 is provided at one location on the outer wall 104, and angles from the base plate 102 to the top of the outer wall 104. The spout 116 assists the user in pouring leftover bubble solution from the dish 100 back into the original bubble solution container.

Figure 8A:
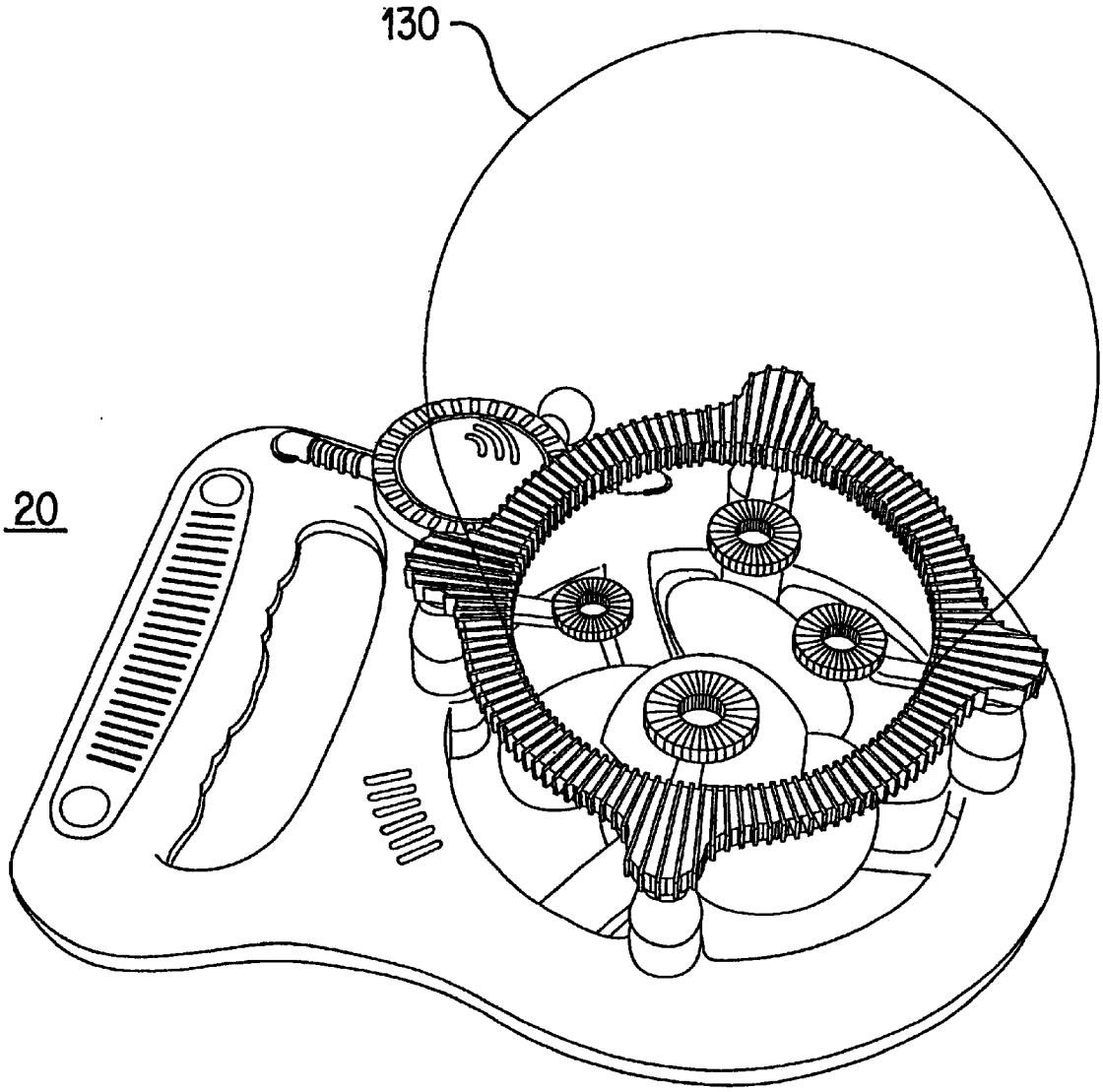
FIGS. 8A–8C illustrate the operation of the assembly of FIG. 1.
Figure 8B:
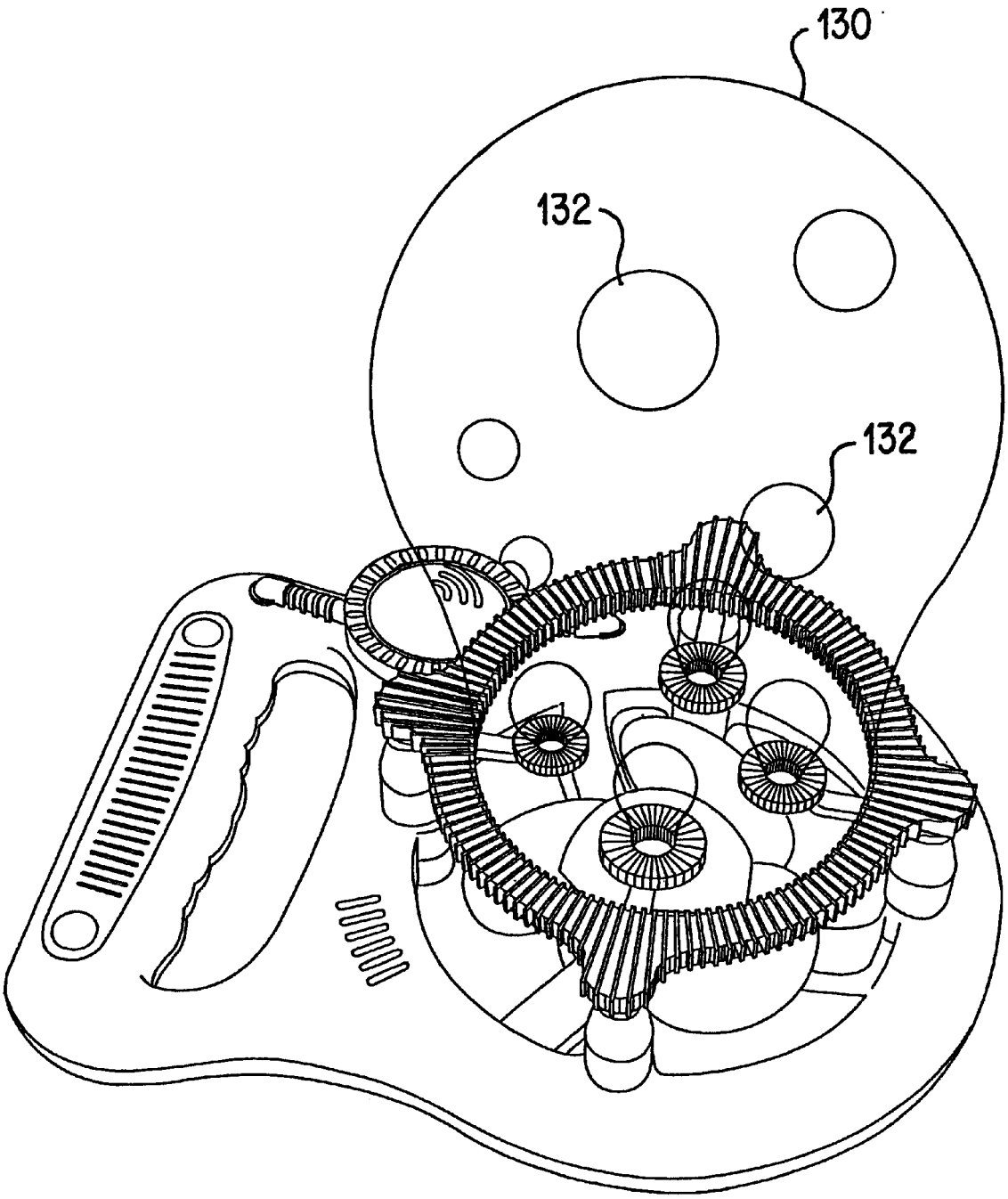
Figure 8C:
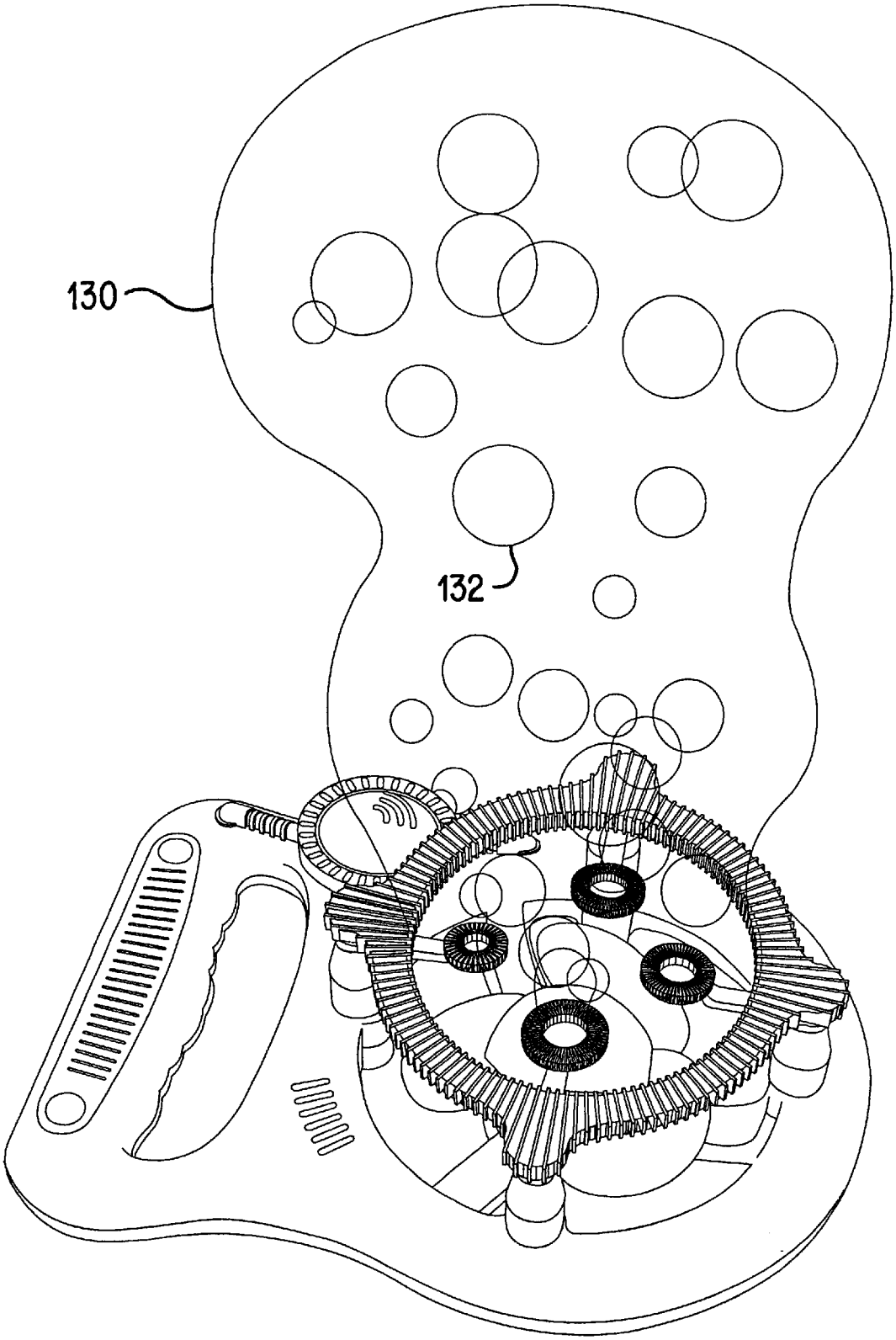

The operation of the assembly 20 is illustrated in connection with FIGS. 8A–8C. First, the bubble producing device 28 is dipped into the dish 100, which holds bubble solution in both its spaces 108, 110. Any conventional bubble solution can be used. The primary ring 60 is received inside the outer space 108 and can be rested therein until the primary ring 60 contacts the base plate 102. When the primary ring 60 contacts the base plate 102, the secondary rings 82 will be received inside the inner space 110 and may possibly contact the inner plate 114. The bubble producing device 28 is then removed from the dish 100 and the protrusions 78 of the legs 68 inserted into the openings 36 to secure the bubble producing device 28 on the frame 22 of the assembly 20.

Alternatively, the bubble producing device 28 can first be secured on to the frame 22 of the assembly 20 before dipping into the dish 100.

With bubble solution now extending in the form of a film across the openings of the rings 60 and 82, the user actuates the fan 30 by turning the lever arm 220. The speed of rotation of the fan 30 is controlled by turning the lever arm 220 in the direction of arrow 234. The further lever arm 220 is pivoted away from the "OFF" position (i.e., adjacent stop edge 238), the faster the fan 30 will rotate. Initially, the user rotates the fan 30 at a lower speed to cause only the primary ring 60 to partially produce a large enclosing bubble 130 (see FIG. 8A). The low speed of the fan 30 means that the smaller bubbles of the secondary rings 82 are not produced, because there is a lesser quantity of bubble solution extending across the openings of the smaller secondary rings 82 which does not react as easily with the wind source. As the larger bubble 130 is being created, the user accelerates the rotation of the fan 30 to create a plurality of smaller bubbles 132 from the four secondary rings 82 (see FIG. 8B). Depending on the amount of bubble solution remaining on the secondary rings 82, each secondary ring 82 can produce more than one smaller bubble 132. The accelerated rotation of the fan 30 causes the larger bubble 130 to enlarge or grow in size. Continued rotation of the fan 30 will complete the creation of the larger bubble 130 so that it completely encloses the smaller bubbles 132 (see FIG. 8C). Accelerated rotation of the fan 30 will also push the completed larger bubble 130 out of the primary ring 60.

Instead of providing the complete assembly 20 as illustrated in FIG. 1A, it is also possible for the user to use the bubble producing device 28 alone to produce bubbles. For example, if the sizes of the rings 60 and 82 are sufficiently small, a shaft or wand can be attached to the primary ring 60, so that the user can grip the shaft, dip the bubble producing device 28 into the dish 100, and then blow air at the rings 60 and 82 to produce the bubbles 130, 132, varying the blowing force to create the larger bubble 130 before the smaller bubbles 132. Alternatively, the user can grip the shaft that connects the bubble producing device 28 and place it in front of (i.e., in the path of) a separate fan unit to create the desired bubbles 130, 132. Thus, the bubble producing device 28 can be utilized without the fan 30 of the assembly 20.

Figure 12:
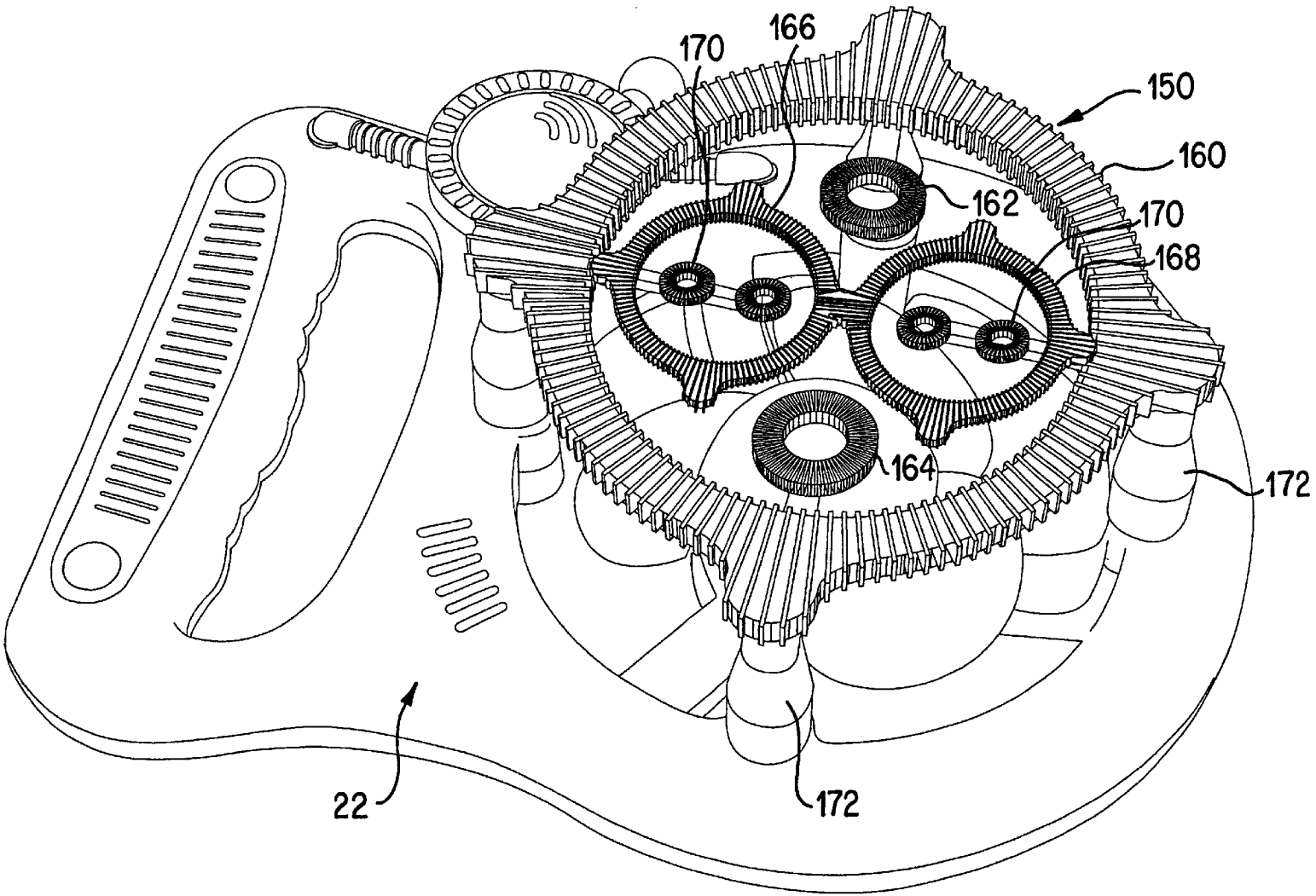
FIG. 12 is a perspective view of a bubble producing device according to another embodiment which can be used with the assembly of FIG. 1.

Although FIGS. 1–8 illustrate a bubble producing device 28 as having two levels of rings, so that a plurality of smaller bubbles 132 are produced inside a larger enclosing bubble 130, this is merely illustrative of the basic principles of the present invention. It is also possible to provide more than two levels of rings to create even smaller bubbles within each small bubble 132. For example, FIG. 12 illustrates a bubble producing device 150 having a large primary ring 160 (just like primary ring 60), a second layer of intermediate rings 162, 164, 166, 168, and a third layer of smaller rings 170. The intermediate rings 162 and 164 in the second layer are smaller than the intermediate rings 166 and 168, and do not have any other rings provided therewithin. However, intermediate rings 166, 168 each has two smaller rings 170 provided therewithin. The three layers of rings are at different vertical levels, and each layer can be supported from a different vertical point in each leg 172 of the bubble producing device 150.

Figure 13:
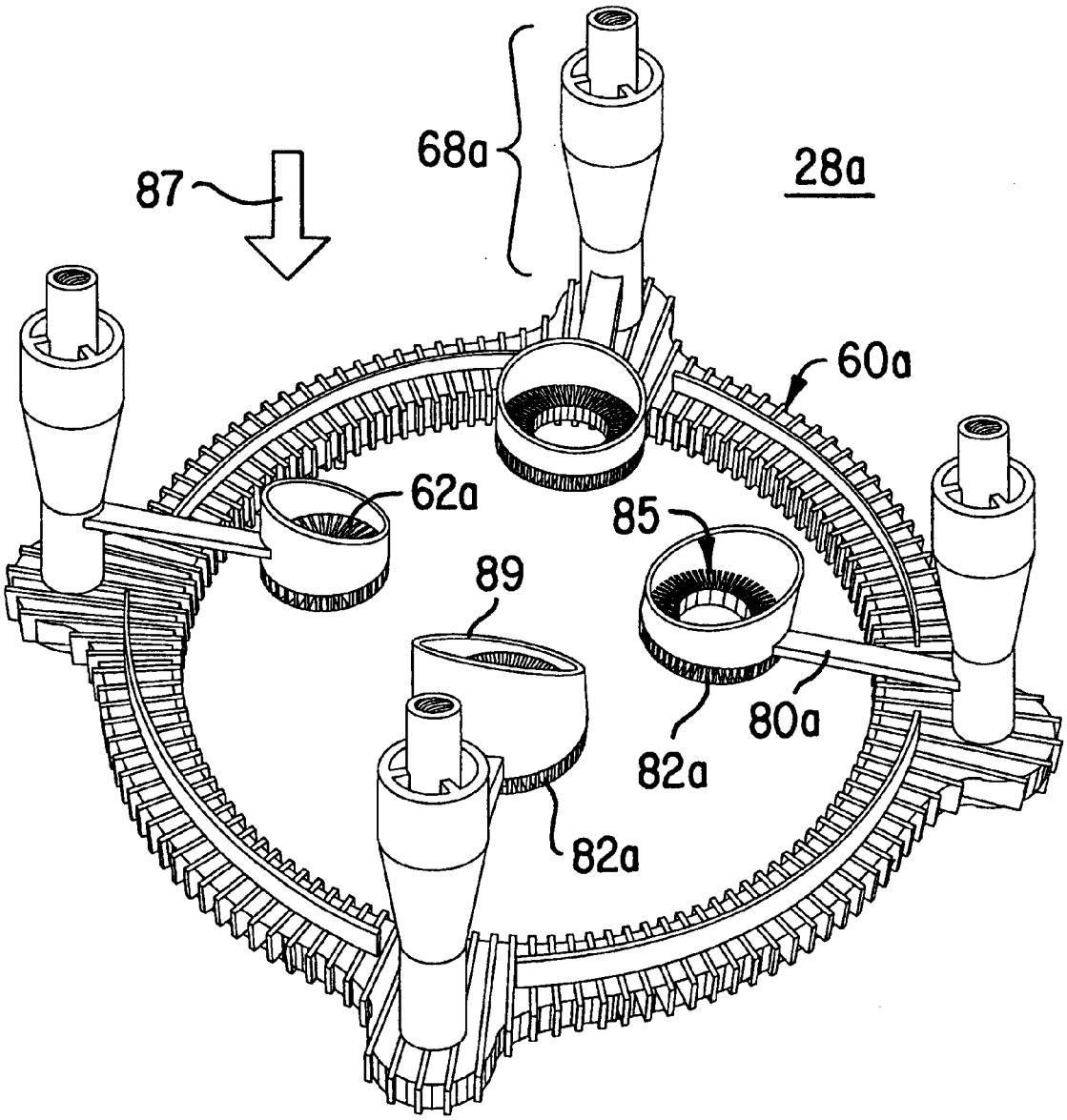
FIG. 13 is a bottom perspective view of a bubble producing device according to yet another embodiment which can be used with the assembly of FIG. 1.
Figure 14:
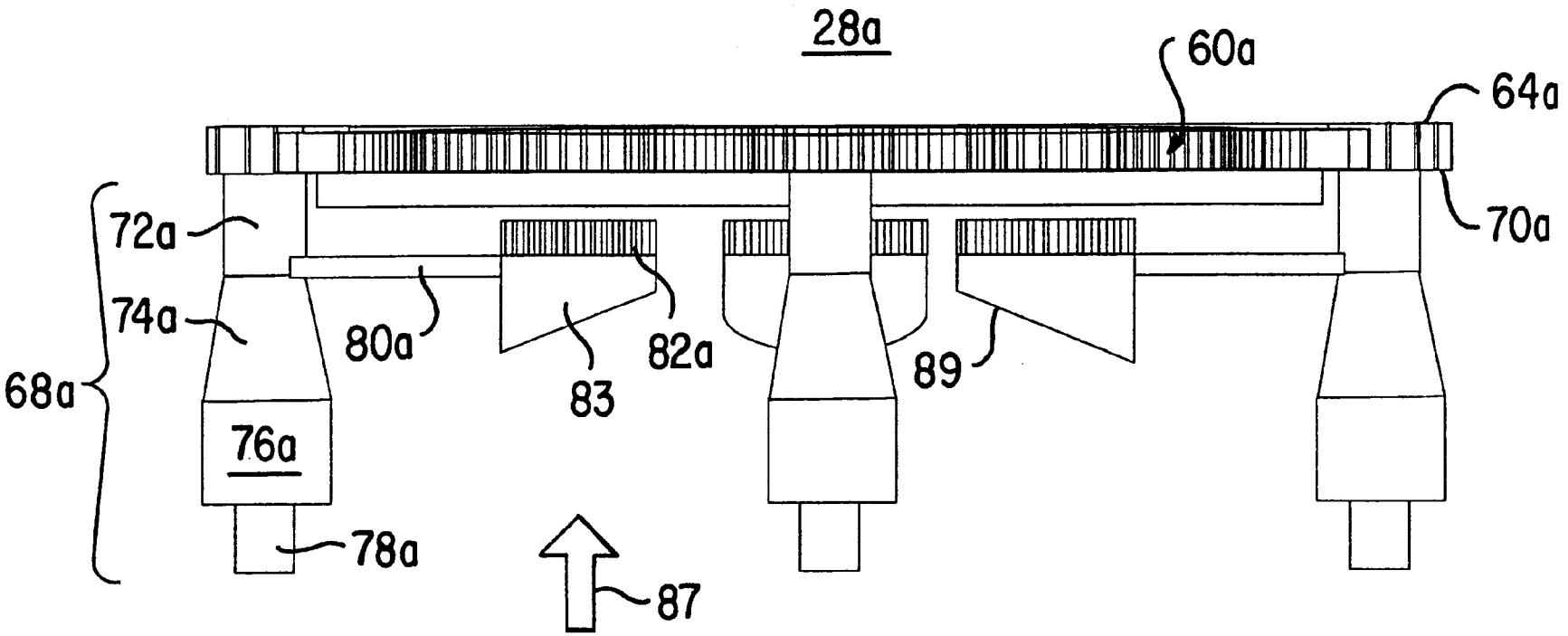
FIG. 14 is a side plan view of the bubble producing device of FIG. 13.

FIGS. 13 and 14 illustrate a modification that can be made to the bubble producing device 24 of FIGS. 2 and 3. The bubble producing device 28*a* of FIGS. 13 and 14 is the same as bubble producing device 28 of FIGS. 2 and 3 except for the provision of cylindrical walls 83 provided for each secondary ring 82*a*, so the same numeral designations are used except that an "a" has been added to the designations in FIGS. 13 and 14. As shown in FIGS. 13 and 14, each secondary ring 82*a* has a cylindrical wall 83 extending vertically downwardly from the ring 82*a* to form a tube-like extension. As shown in FIG. 13, the wall 83 can extend from the outer periphery of its corresponding ring 82*a*, so that the ridges 62*a* of the secondary rings 82*a* are disposed inside the wall 83 to further facilitate holding the bubble solution against the ring 82*a* to form a solution film that is blown to form the bubble. Each wall 83 defines a channel 85 that allows air generated from the bottom of the bubble producing device 28*a* (see direction of arrow 87) to enter each channel 85 from the bottom edge 89 of the corresponding wall 83. Each channel 85 functions to direct a collected mass of air towards its corresponding secondary ring 82*a*, to further facilitate the generation of a full and complete bubble by the secondary ring 82*a*.

To further enhance the quality of the bubble produced by the secondary rings 82*a*, each wall 83 is angled. In other words, each wall 83 can be configured so that it has a varying length (as measured from the secondary ring 82*a*) around its circumference. For example, referring to FIG. 14, the bottom edge 89 of each wall 83 can be cut at an angle with respect to the horizontal axis defined by the primary ring 60*a*. The angled configuration of the walls 83 shown in FIGS. 13 and 14 efficiently captures the spiraling air that is created by a rotating fan 30. Each angled cylindrical wall 83 traps the air and concentrates the trapped air mass to direct them through the secondary rings 82*a*. This increases the amount of air that actually passes through the corresponding secondary ring 82*a*, and minimizes air that passes around the secondary ring 82*a*. As a result, better and more consistent streams of smaller bubbles can be created by the secondary rings 82*a*.

In addition, the quality of the bubble produced by the secondary rings 82*a* can be even further enhanced by increasing the length of the walls 83. This is because a longer cylindrical wall 83 has an increased inner volume (i.e., a greater volume in the channel 85) so that more air can be trapped and concentrated. However, if the length of the walls 83 is increased, greater air flow must be provided because the air that is trapped inside the respective channels 85 must travel a greater distance to reach the secondary rings 82*a*.

The method of operation for the bubble producing device 28*a* of FIGS. 13 and 14 can be the same as that described above in connection with FIGS. 8A–8C, except that the generated air is trapped by the walls 83 and directed to the secondary rings 82*a* by the force created by the additional air being generated behind it.

The walls 83 can be provided for any of the secondary rings, including the rings 162, 164, 166, 168 and 170 shown in FIG. 12.

Thus, the bubble producing devices described hereinabove are easy to use, and consistently provide multiple bubbles inside larger enclosing bubbles, thereby increasing the amusement value and play variety for the user. The provision of the bubble-producing rings 60, 82, 82*a* at separate, spaced-apart and offset levels ensure that the differently-sized bubbles 130, 132 are produced in a consistent and effective manner.

Figure 15:
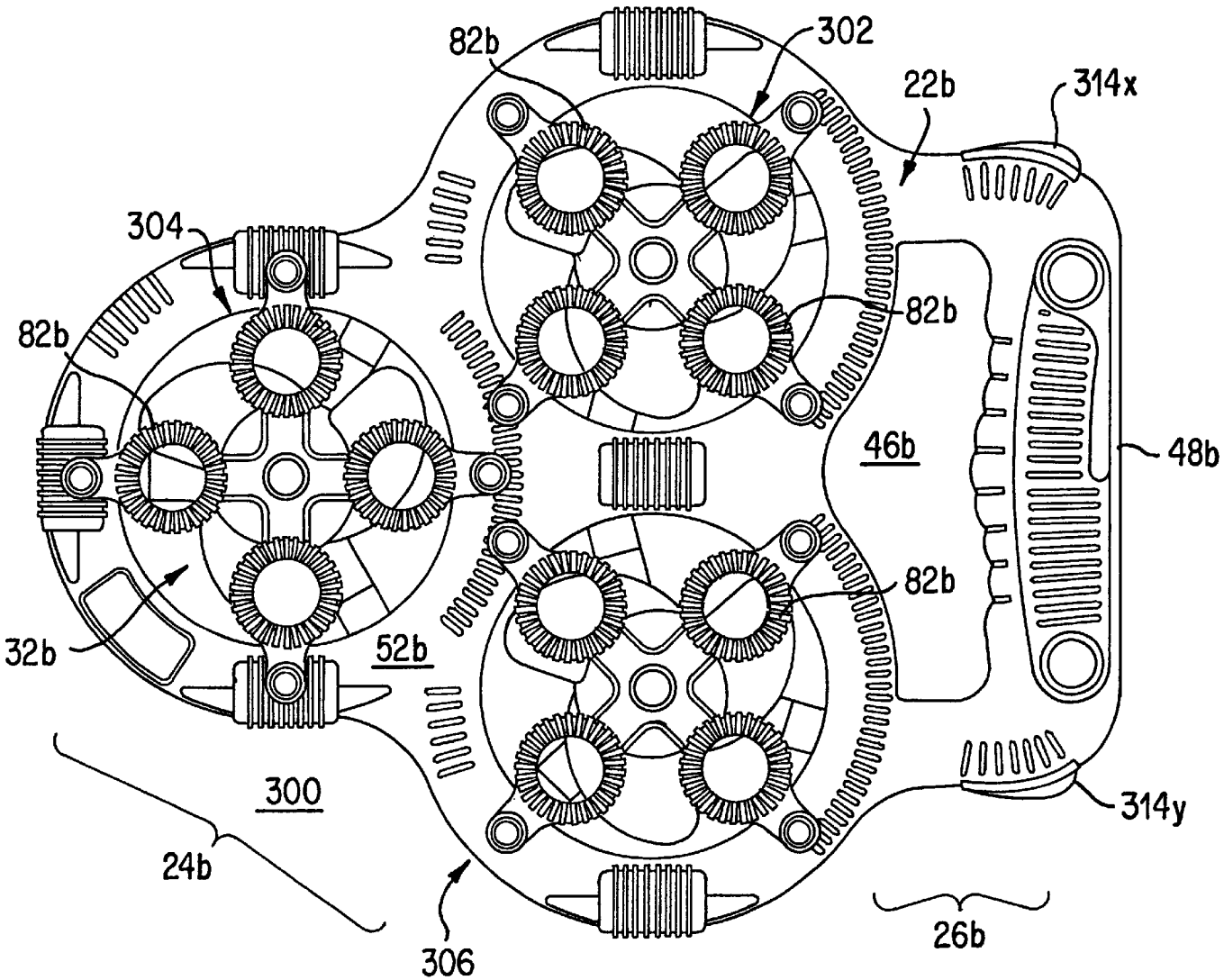
FIG. 15 is a top plan view of a bubble producing assembly according to yet another embodiment of the present invention.
Figure 16:
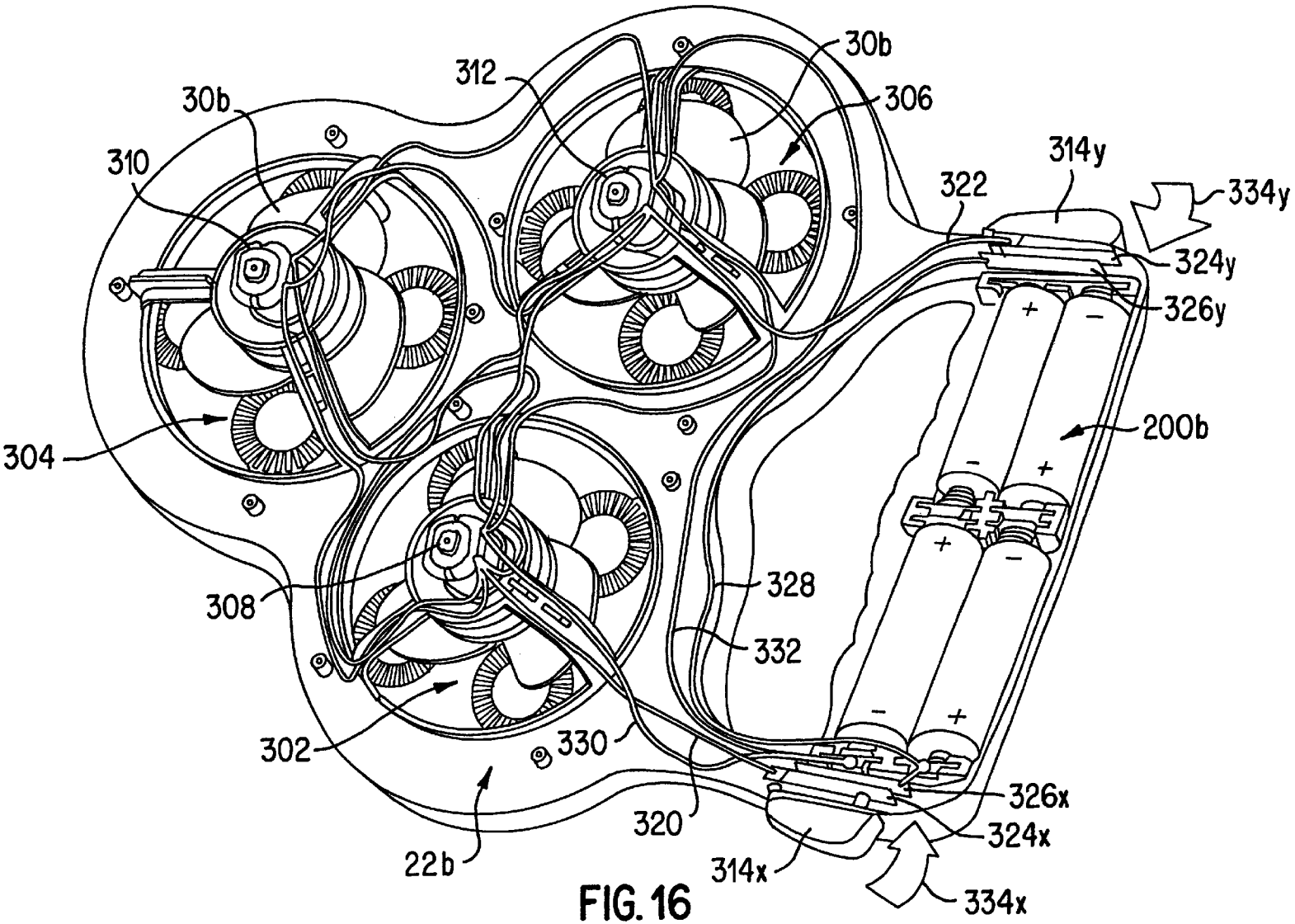
FIG. 16 is a bottom plan view of the bubble producing assembly of FIG. 15.
Figure 17:
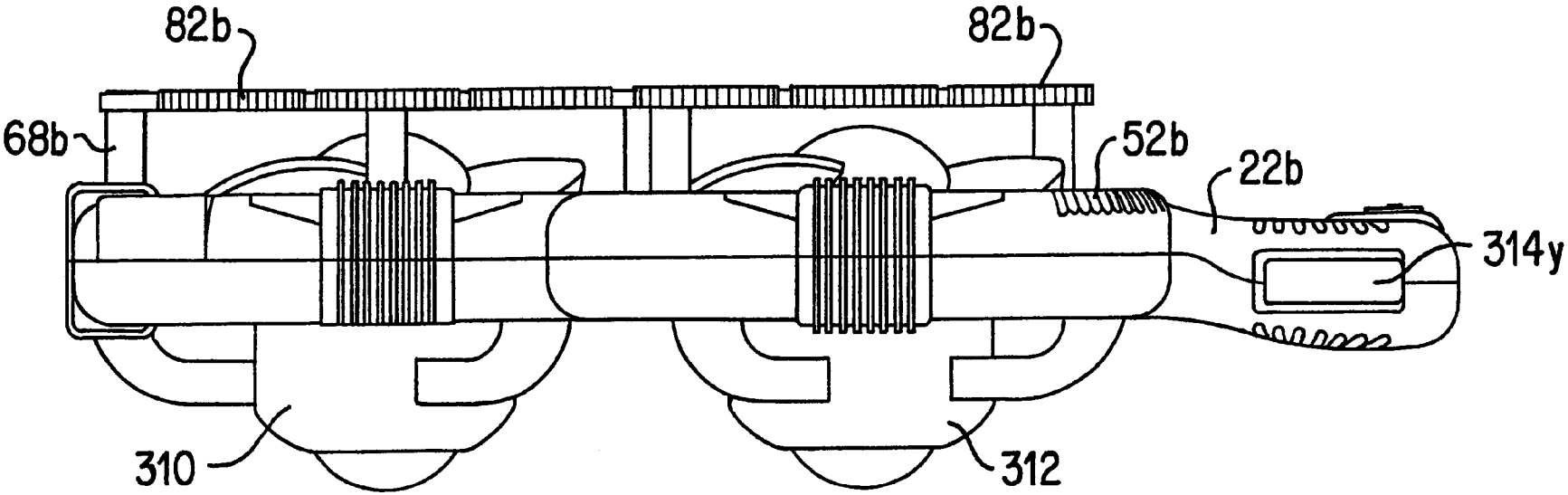
FIG. 17 is a side plan view of the bubble producing assembly of FIG. 15.

Referring now to FIGS. 15–17, the present invention also provides a bubble producing assembly 300 that produces a plurality of separate bubbles upon the actuation of a single control mechanism. Bubble producing assembly 300 is essentially the same as bubble producing assembly 20 of FIG. 1 except for the differences noted hereinbelow. Therefore, the same numeral designations are used in FIGS. 1–4 and 15–17 where possible except that a "b" has been added to the designations in FIGS. 15–17.

The bubble producing assembly 300 differs primarily from the bubble producing assembly 20 of FIG. 1 in that it provides three separate bubble producing devices 302, 304, 306, instead of the one bubble producing device 28 for assembly 20. In addition, the lever mechanism 50 in assembly 20 is replaced by a control mechanism 314 that can simultaneously actuate all three bubble producing devices 302, 304, 306. Each bubble producing device 302, 304, 306 can have the same or a similar configuration, and each is controlled or driven by a separate motor 308, 310, 312, respectively. As shown in FIG. 16, the control mechanism 314 can comprise two switches 314*x* and 314*y* that control the operation of the motors 308, 310, 312, although one switch 314*x* or 314*y* alone is sufficient to control the operation of the motors 308, 310, 312. Each switch 314*x* and 314*y* is fitted through an opening in the frame 22*b* and has a contact plate 324*x* and 324*y*, respectively. Each contact plate 324*x* and 324*y* is wired to at least one of the three motors 308, 310 or 312 (e.g., see wires 320 and 322 that couple the plates 324*x* and 324*y*, respectively, to motors 302 and 306, respectively), and each motor 308, 310, 312 is further wired to the other two motors, so that all three motors 308, 310, 312 can be simultaneously driven when either or both switches 314*x* and 314*y* is actuated. In addition, terminal plates 326*x* and 326*y* are provided at the opposing terminals of the battery system 200*b*, with the terminal plates 326*x* and 326*y* coupled by a wire 328, and with additional wires 330 and 332 coupling the terminal plate 326*x* with the motors 302 and 306, respectively.

All the motors 302, 304 306 are simultaneously actuated (i.e., driven) when either switch 314*x* or 314*y* is pressed in the direction of arrow 334*x* or 334*y*, respectively, which causes the contact plate 324*x* or 324*y* to contact the corresponding terminal plate 326*x* or 326*y*, respectively. Alternatively, both switches 314*x* and 314*y* can be pressed at or about the same time to actuate all the motors 302, 304, 306.

Another difference between the bubble producing assembly 300 and the bubble producing assembly 20 of FIG. 1 lie in the structure of the bubble producing devices 302, 304, 306 and 28. While the bubble producing device 28 has one primary ring 60 and a plurality of secondary rings 82 positioned in an offset manner, each bubble producing device 302, 304, 306 has no primary ring 60, but has a plurality of spaced-apart rings 82*b* that are the same in construction as the secondary rings 82 shown in FIGS. 1–4. As shown in greater detail in FIGS. 15 and 17, each ring 82*b* extends radially inwardly into the opening 22*b* from a leg 68*b* that extends vertically from the top surface 52*b* of the frame 22*b*. Although FIG. 15 illustrates that each bubble producing device 302, 304, 306 has four rings 82*b*, any number of rings 82*b* can be provided for each bubble producing device 302, 304, 306. In addition, even though all the rings 82*b* are illustrated as being positioned at the same vertical level, it is also possible to offset some of the rings 82*b* with respect to other rings 82*b* of the same or other bubble producing devices.

Figure 18:
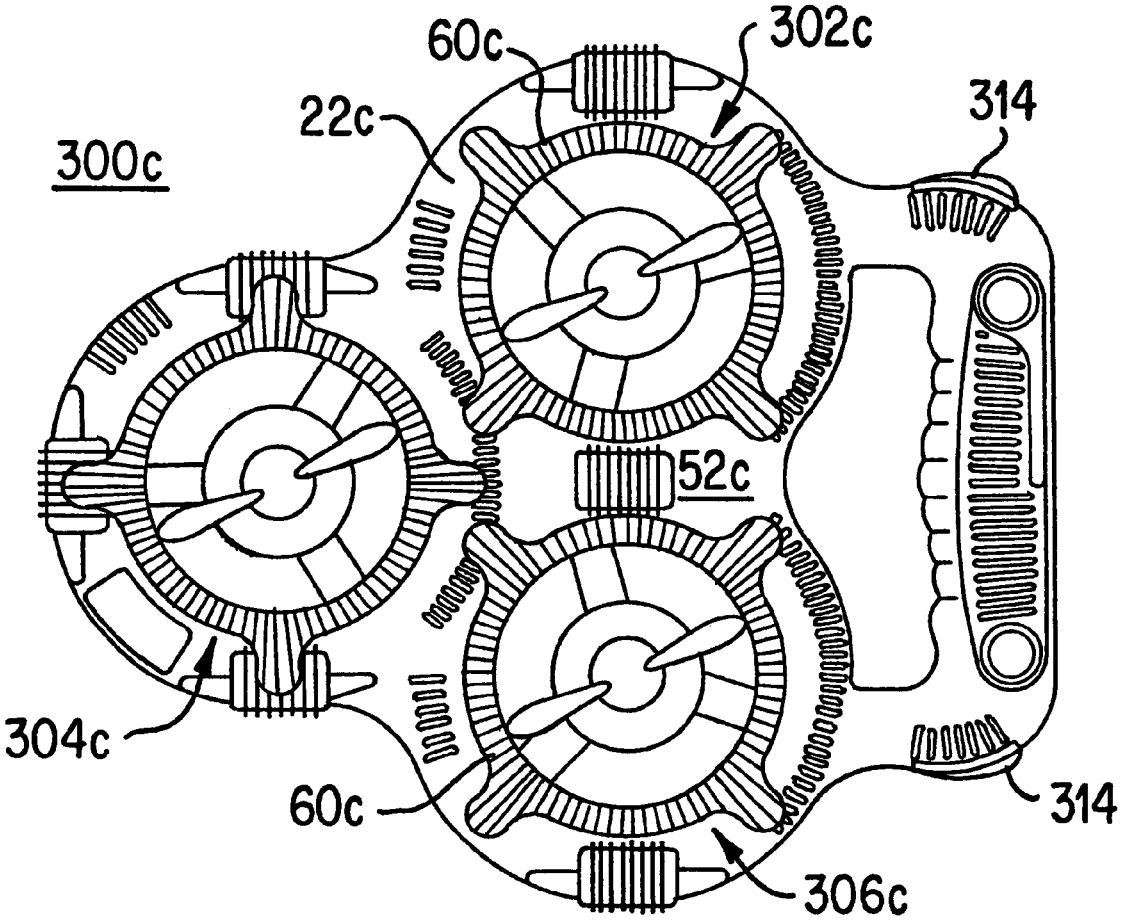
FIG. 18 is a top plan view of a bubble producing assembly according to yet a further embodiment of the present invention.

FIG. 18 illustrates a bubble producing assembly 300*c* that includes a modification made to the bubble producing assembly 300. The assemblies 300 and 300*c* are the same, except that each bubble producing device 302*c*, 304*c*, 306*c* in FIG. 18 has one ring 60*c*, which can have the same construction as the primary rings 60 in FIGS. 1–4, and has no secondary rings 82 or 82*b*. Therefore, the same numeral designations are used in FIGS. 15–17 and 18 where possible except that a "c" has been added to the designations in FIG. 18. Each ring 60*c* can be supported by a plurality of legs (not shown) that extend vertically from the top surface 52*c* of the frame 22*c*.

The method of operation for the bubble producing assemblies 300 and 300*c* of FIGS. 15–18 can be the same as that described above in connection with FIGS. 8A–8C, except that the assembly 300 will produce a plurality of separate bubbles, and the assembly 300*c* will produce fewer but larger bubbles than the assembly 300. The bubbles produced by the assembly 300*c* are also separated. Thus, neither assembly 300 or 300*c* will produce a plurality of bubbles within an enclosing larger bubble. However, it will also be appreciated by those skilled in the art that the bubble producing devices 28 and 28*a* can also be used with the assemblies 300 and 300*c* to provide a plurality of larger enclosing bubbles that each contain a plurality of bubbles therein.

Although FIGS. 15–18 illustrate bubble producing assemblies 300 and 300*c* that have a certain number of motors, bubble producing devices and rings, it is also possible to provide any number of motors, bubble producing devices and rings as desired to make up a bubble producing assembly.

Figure 19:
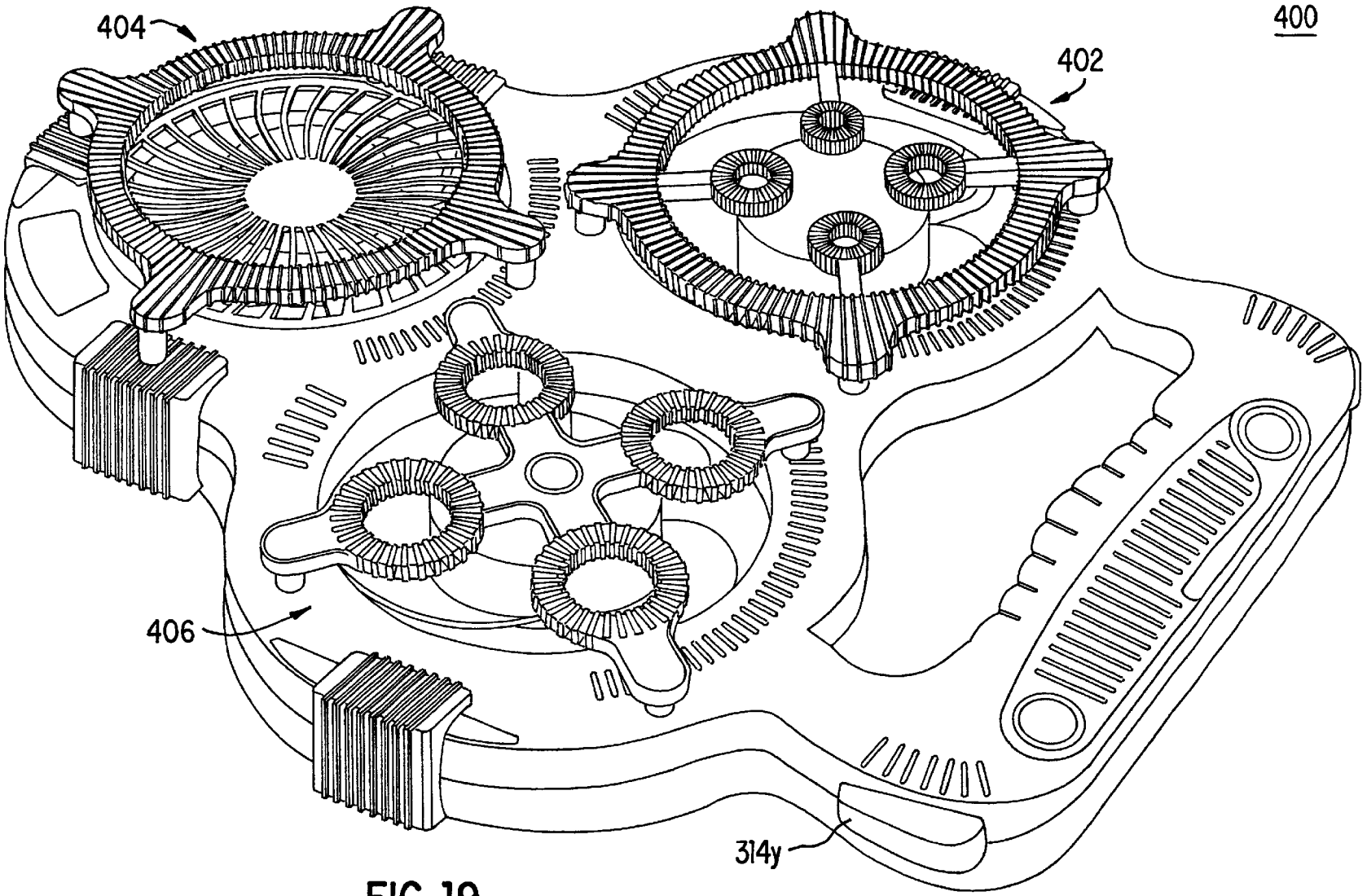
FIG. 19 is a top perspective view of a bubble producing assembly according to yet another embodiment of the present invention.

In addition, all the principles illustrated in FIGS. 1–11 and 15–18 above can be combined, as embodied by the bubble producing assembly 400 in FIG. 19. The bubble producing assembly 400 utilizes the same housing, motors 308, 310, 312, and switches 314*x*, 314*y* as for assembly 300 in FIG. 16. In fact the bottom view of the assembly 400 can be the same as that which is shown in FIG. 16. The primary difference between the assemblies 300 and 400 is that while the three bubble producing devices 302, 304, 306 in assembly 300 can be the same, the three bubble producing devices 402, 404, 406 in assembly 400 can be entirely different from each other. For example, the bubble producing device 402 can be the same as the bubble producing device 28, which has one primary ring 60 and a plurality of secondary rings 82 that are positioned in an offset manner. The bubble producing device 406 can be the same as the bubble producing device 302, which has a plurality of spaced-apart rings 82*b* that are the same in construction as the secondary rings 82 shown in FIGS. 1–4. In addition, the bubble producing device 404 can be the same as bubble producing device 302*c* in FIG. 18, which has one ring 60*c* and can have the same construction as the primary rings 60 in FIGS. 1–4, and which has no secondary rings 82 or 82*b*.

Thus, the bubble producing assembly 400 in FIG. 19 can be operated in the same manner as the assemblies 300 and 300*c* in FIGS. 15–18, except that the assembly 400 would simultaneously produce three different types of bubbles. Specifically, the bubble producing device 402 would produce a plurality of smaller bubbles within a larger bubble, the bubble producing device 406 would produce a plurality of separate bubbles, and the bubble producing device 404 will produce single large bubbles without any bubbles retained inside. Thus, the assembly 400 would simultaneously produce three different types of bubbles. These different types of bubbles provide the user with enhanced play variety and amusement.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble producing assembly, comprising:

(a) a frame having a handle section;

(b) a first bubble producing device retained in the frame and having:

a primary loop having an enclosing edge that defines an interior opening, the primary loop disposed at a first vertical level; and a plurality of secondary loops disposed at a second vertical level that is different from the first vertical level, the secondary loops positioned with respect to the primary loop such that the secondary loops extend into the space defined by the interior opening; and (c) a second bubble producing device, separate from the first bubble producing device, retained in the frame and having at least one loop.

2. The assembly of claim 1, wherein the frame has at least one opening, the assembly further including:

at least one fan positioned inside the at least one opening; and at least one motor coupled to the at least one fan.

3. The assembly of claim 2, further including a control mechanism coupled to each of the at least one motor for simultaneously actuating each of the at least one motor.

4. The assembly of claim 1, further including a control mechanism coupled to each bubble producing device.

5. The assembly of claim 4, wherein the control mechanism is a switch.

6. The assembly of claim 1, wherein the secondary loop is smaller in size than the primary loop.

7. The assembly of claim 6, wherein the secondary loop has an outer periphery, with a tube extending from the outer periphery thereof.

8. The assembly of claim 1, wherein the at least one loop has a plurality of ridges provided thereon.

9. The assembly of claim 3, further including a battery system coupled to the control mechanism and the at least one motor.

10. The assembly of claim 1, wherein the at least one loop comprises one loop.

11. The assembly of claim 10, further including a third bubble producing device, separate from the first and second bubble producing devices, retained in the frame and having a plurality of loops.

12. The assembly of claim 1, wherein the at least one loop comprises a plurality of loops.

13. A bubble producing assembly, comprising:

(a) a frame having a handle section;

(b) a first bubble producing device retained in the frame and having at least one loop; and (c) a second bubble producing device, separate from the first bubble producing device, retained in the frame and having at least one loop;

wherein the first and second bubble producing devices are in stationed positions with respect to the frame.

14. The assembly of claim 13, wherein the frame has at least one opening, the assembly further including:

at least one fan positioned inside the at least one opening; and at least one motor coupled to the at least one fan.

15. The assembly of claim 14, further including a control mechanism coupled to each of the at least one motor for simultaneously actuating each of the at least one motor.

16. The assembly of claim 13, further including a control mechanism coupled to each bubble producing device.

17. The assembly of claim 16, wherein the control mechanism is a switch.

18. A bubble producing assembly, comprising:

a frame;

a first bubble producing device retained by the frame and having at least one loop;

a second bubble producing device retained by the frame and having at least one loop;

a first air generating device retained in the frame and operatively directed at the first bubble producing device; and a second air generating device retained in the frame and operatively directed at the second bubble producing device.

19. A bubble producing assembly, comprising:

a frame having a top surface;

a first bubble producing device having at least one loop; and a second bubble producing device having at least one loop;

wherein the first and second bubble producing devices are positioned in spaced-apart manner along the top surface of the frame.

* * * * *